United States Patent [19]

Lam et al.

[11] 4,084,351

[45] Apr. 18, 1978

[54] VIBRATION FREE DIAMOND POLISHING WORKBENCH

[76] Inventors: David Nicholas Lam, 217 N. Queens Ave., Massapequa, N.Y. 11758; Stephen Joseph Lam, 34-35 76th St., Jackson Heights, N.Y. 11372

[21] Appl. No.: 778,843

[22] Filed: Mar. 18, 1977

[51] Int. Cl.[2] ..... B24B 41/06; B24B 7/22; B28D 5/00

[52] U.S. Cl. ..... 51/109 R; 51/240 R; 51/166 FB; 125/30 R; 248/22

[58] Field of Search ..... 51/109 R, 51/125, 166 FB, 240 R, 240 A, 229; 125/30, 35; 248/22, 13; 108/136; 274/39 A; 144/286 R, 286 A

[56] References Cited

U.S. PATENT DOCUMENTS

| | | | |
|---|---|---|---|
| 1,243,491 | 10/1917 | De Uries | 51/109 R |
| 2,320,377 | 6/1943 | Mueller | 125/30 R X |
| 2,386,248 | 10/1945 | Marzetti | 248/22 |
| 2,949,908 | 8/1960 | McElroy | 125/30 R |
| 3,968,728 | 7/1976 | Goldfarb | 51/240 R X |

*Primary Examiner*—Al Lawrence Smith
*Assistant Examiner*—Nicholas P. Godici
*Attorney, Agent, or Firm*—Ostrolenk, Faber, Gerb & Soffen

[57] ABSTRACT

A diamond polishing workbench having a top working surface substantially free of vibration comprises an open rectangular steel frame having a peripheral shoulder on its interior. A first support table is rested within the shoulder and is mechanically insulated from the frame by a vibration damping material and a polishing wheel mount is connected to the first table. A second table is seated on the upper surface of the frame and is also mechanically insulated from the frame by a suitable vibration damping material.

9 Claims, 2 Drawing Figures

VIBRATION FREE DIAMOND POLISHING WORKBENCH

BACKGROUND OF THE INVENTION

The cutting or polishing of diamonds and similar stones is usually accomplished at workbenches to which a spindle carrying a horizontal or flat wheel or lap has been mounted. A suitable polishing agent, such as a mixture of diamond dust and oil, is placed on the wheel and the stone to be cut is brought into contact therewith. The wheels are necessarily run at very high speeds, for example, in the neighborhood of 3,000 RPM.

In order to properly effect the cutting and polishing of the stone and avoid interrupted cutting or polishing which can cause damage to the diamond and tremendously decrease the commercial value of the stone, it is necessary that the work table and wheel run perfectly true and with minimal vibration. Various methods of constructing the wheel and spindle and mounting it to a bracket held by the working surface of the work bench have been developed, one of which is shown in U.S. Pat. No. 1,374,267. However, because of the means by which the wheel must be held by the work bench and because of the very high speeds at which the wheels are run, a significant degree of vibration is imparted from the wheel to the work surface making the proper cutting or polishing difficult and dangerous. The difficulty is further aggrevated by the means by which the stone to be cut is brought in contact with the wheel surface. The stone is usually held in a stone holder or dop which is generally a U-shaped object having tongs at one end for holding the stone. The other end of the dop is rested on the work surface and the tong end is pivoted to bring the stone in contact with the wheel. Since the dop is not connected to the work surface, a "bouncing" motion is then imparted from the vibration of the work surface to the dop.

Various designs have been employed in the past to reduce the vibration of the work surface. For example, rubber bushings have been inserted to separate the work surface from the spindle. While such designs have reduced the degree of vibration, they have not been successful in substantially freeing the work surface of vibration.

Accordingly, it is the object of this invention to provide a diamond polishing work bench which has a top working surface on which the dop is rested which is substantially free of vibration.

This and other objects of the invention will become apparent to those skilled in the art from the following detailed description in which FIG. 1 is a cross sectional view of the workbench of the instant invention, and FIG. 2 is a top view of the workbench with the second table, wheel and spindle removed.

SUMMARY OF THE INVENTION

This invention relates to a diamond polishing workbench whose top surface is substantially free of vibration. More particularly, it relates to a diamond polishing workbench having a substantially vibration-free top table surface in which the table carrying the spindle is isolated from the frame of the bench by first vibration damping means, and the top working table is also isolated from the frame by second vibration damping means and the spindle carrying table and top working table are consequently isolated from each other.

DESCRIPTION OF THE PREFERRED EMBODIMENTS

Figure 1:
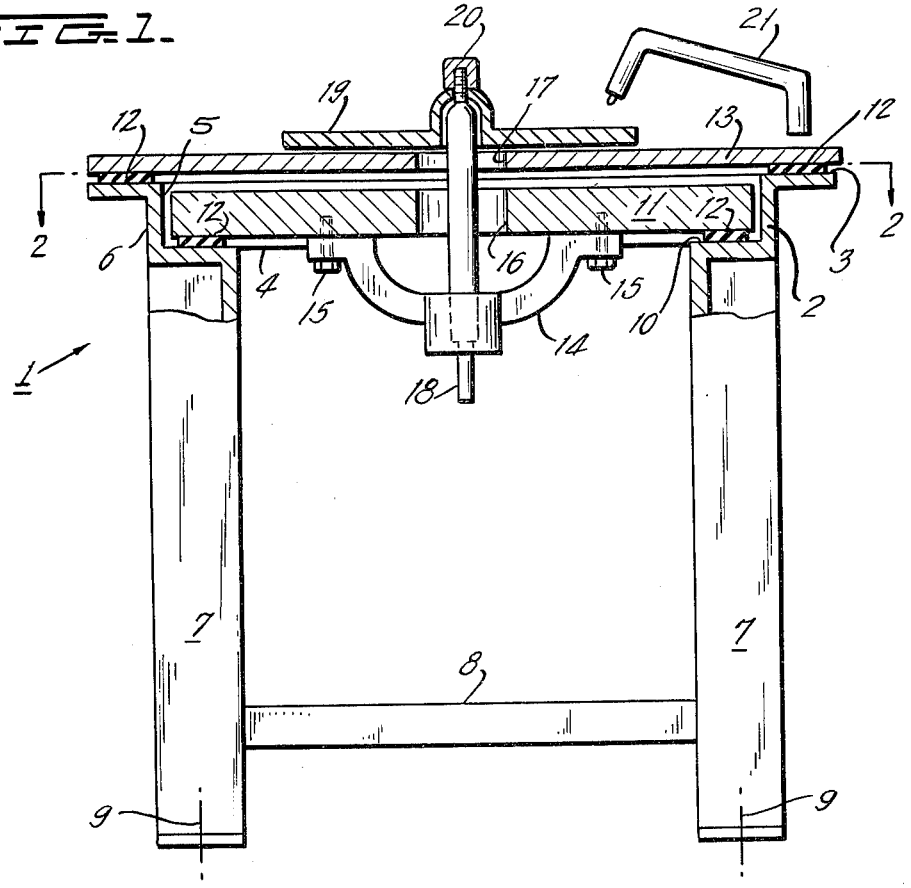
Figure 2:
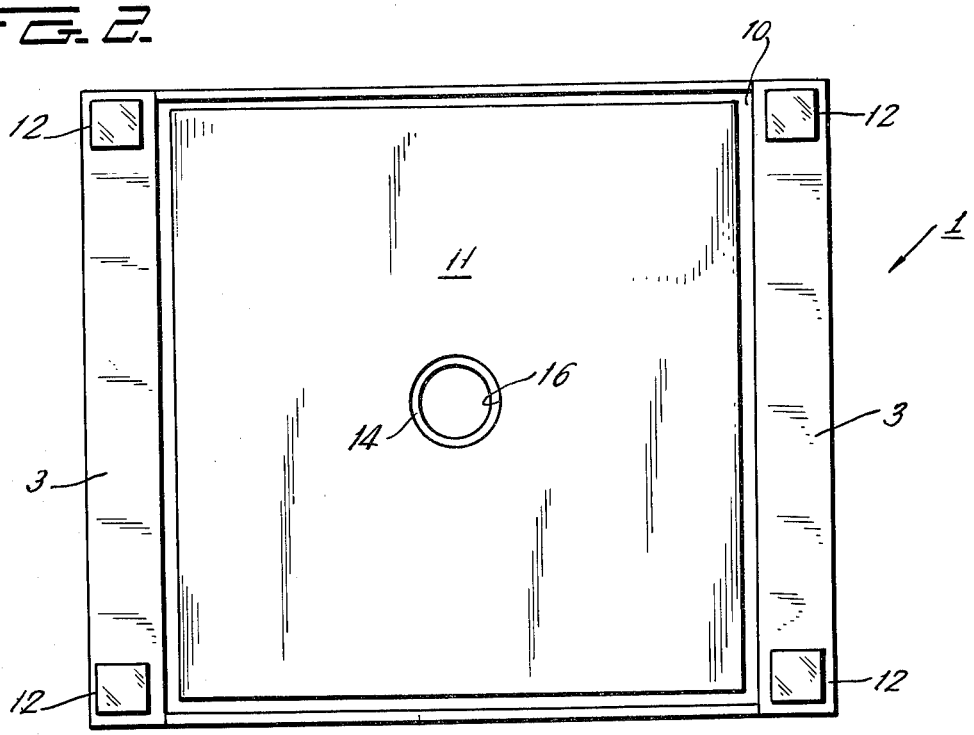

The workbench of the present invention has a frame 1 which is constructed of connected lateral members 2 which have a common upper surface 3, a common lower surface 4, interior surfaces 5 and outer surfaces 6. Frame 1 can be of any desired shape but is generally rectangular. Frame 1 has a plurality of legs 7, preferably one at each corner, extending downwardly from lower surface 4. Frame 1 and legs 7 can be constructed from any suitable material but are preferably steel and are also preferably of unitary construction. It is also preferred to provide suitable braces 8 between adjacent legs. Leveling screws 9 are provided at the bottom of each leg 7.

The interior surface 5 of each of the lateral members 2 is provided with a step 10 of predetermined height in order to define an interior ledge or shoulder. A first table 11 is seated on ledge 10 and separated therefrom by a means 12 to dampen vibration. Table 11 can be held in place by the force of gravity, or by a suitable bolt arrangement which does not transfer vibration energy from frame 1 to the table 11. Means 12 can be any suitable material which absorbs vibration such as rubber, cork, polyurethane foam, etc. While means 12 can be provided between all of the facing surfaces of ledge 10 and first table 11, it has been found sufficient to utilize four pads of vibration absorbing material at the four corners of first surface 11. However, in order to achieve the substantially vibration free top working surface which is the object of the present invention, it is necessary that first table 11 does not come into contact with frame 1 except through means 12. In other words, first table 11 cannot touch or be bolted to frame 1. If desired, table 11 can be replaced by a cross-frame member connected to the ledges 10 through vibration absorbing pads.

A top working table 13 of the workbench is seated on the upper surfaces 3 of lateral walls 2 and is separated from upper surfaces 3 by means to dampen vibration 12 in a similar manner as first surface 11 is separated from ledge 10. Table 13 is held in place by the force of gravity. Again, pads of vibration absorbing material at the corners has been found sufficient to accomplish the purposes of this invention and it is not necessary to have all facing surfaces between working surface 12 and frame 1 connected by means 12. It is, however, necessary that top table 13 neither touch nor be bolted to frame 1. It is also necessary that top table 13 and first table 11 do not come into contact with each other. This can be conveniently accomplished by making the thickness of first table 11 less than the height of step 10.

A bracket means 14 which is adapted to hold a spindle is mounted to the bottom of first table 11 by any suitable means such as bolts 15. Aligned apertures 16, 17, usually circular, are provided in first table 11 and top table 13, respectively, usually at the center thereof to permit passage of the spindle therethrough. A spindle 18 is held in bracket 14 and passes upwardly through aligned apertures 16 and 17 beyond the top of working table 13. A horizontal polishing wheel 19 is mounted on spindle 18 and held in place by any suitable means such as cap 20 such that the bottom of wheel 19 is just above and out of contact with the top of top table 13.

In operation, vibration is imparted to first table 11 by wheel 19 through spindle 18 and bracket 14. However, most of the vibration is not translated to frame 1 because it is absorbed in the means 12 to dampen vibration between first surface 11 and frame 1. The vibration which is translated to frame 1 is not then translated to working table 13 because it is absorbed in the means 12 to dampen vibration between frame 1 and top surface 13. As a result, a dop 21 can be placed on a steady and substantially vibration-free working surface 13.

Various changes and modifications can be made in this invention without departing from the spirit and scope thereof. The various embodiments disclosed herein were for the purpose of further illustrating this invention but were not intended to limit it.

We claim:

1. A diamond polishing workbench having a top working table substantially free of vibration comprising (A) a frame of connected lateral members having common upper and lower surfaces, said members having interior and exterior surfaces, (B) a step of predetermined height in the interior surface of each of said members thereby defining an interior ledge, (C) a support means supported from said ledge and means to dampen vibration interposed between said support means and said ledge, said support means being out of direct contact with said frame, (D) a work table seated on said upper surfaces of said lateral members and means to dampen vibration interposed between said work table and said upper surfaces, said work table being out of direct contact with said support means and said frame.

2. The workbench of claim 1 having a plurality of downwardly extending legs from lower surfaces of said lateral members.

3. The workbench of claim 2 wherein said frame and legs are of integral metal construction.

4. The workbench of claim 3 having bracket means to hold a spindle mounted to the bottom of said support means.

5. The workbench of claim 4 wherein said support means and work table have respective apertures therein aligned with said bracket means to permit passage of a spindle through said first and second surfaces.

6. The workbench of claim 5 having a spindle held in said bracket and passing through said aligned apertures.

7. The workbench of claim 6 having a horizontal polishing wheel mounted to said spindle above and out of contact with said work table.

8. The workbench of claim 7 wherein said frame, support means, and work table are substantially rectangular and wherein said apertures are substantially circular and are substantially centrally located in said frame.

9. The workbench of claim 8 wherein said means to dampen vibration are in the form of pads disposed at the corners of said support means and work table respectively.

* * * * *